United States Patent [19]

Sollenberger

[11] Patent Number: 4,974,838

[45] Date of Patent: Dec. 4, 1990

[54] EXERCISE APPARATUS FOR PERFORMING FREE WEIGHT BARBELL EXERCISES

[76] Inventor: Carl E. Sollenberger, 3914 E. Captain Dreyfus, Phoenix, Ariz. 85032

[21] Appl. No.: 413,393

[22] Filed: Sep. 27, 1989

[51] Int. Cl.[5] ..... A63B 21/062

[52] U.S. Cl. ..... 272/118; 272/123

[58] Field of Search ..... 272/117, 118, 123, 134

[56] References Cited

U.S. PATENT DOCUMENTS

| | | | |
|---|---|---|---|
| 3,612,523 | 10/1971 | Glynn | 272/118 |
| 3,627,315 | 12/1971 | Marcyan | 272/118 |
| 3,858,873 | 1/1975 | Jones . | |
| 3,998,454 | 12/1976 | Jones | 272/117 |
| 4,050,310 | 9/1977 | Keiser . | |
| 4,072,309 | 2/1978 | Wilson . | |
| 4,227,689 | 10/1980 | Keiser . | |
| 4,257,590 | 3/1981 | Sullivan et al. | 272/117 |
| 4,257,593 | 3/1981 | Keiser . | |
| 4,339,125 | 7/1982 | Uyeda et al. | 272/118 |
| 4,387,893 | 6/1983 | Baldwin | 272/118 |
| 4,564,194 | 1/1986 | Dawson | 272/123 |
| 4,598,908 | 7/1986 | Morgan | 272/134 |
| 4,603,855 | 8/1986 | Sebelle | 272/117 |
| 4,711,448 | 12/1987 | Minrow et al. | 272/118 |
| 4,781,374 | 11/1988 | Lederman | 272/134 |
| 4,784,384 | 11/1988 | Deola | 272/118 |
| 4,842,271 | 6/1989 | Vinciguerra | 272/118 |

*Primary Examiner*—Robert Bahr

*Attorney, Agent, or Firm*—Don J. Flickinger; Jordan M. Meschkow

[57] ABSTRACT

A multipurpose exercise apparatus for performing free weight bar bell exercises includes a pair of weight frames, each of which includes spaced apart columns and spaced apart horizontal top beams supported by the columns. A weight support member is disposed vertically between the columns and includes a plurality of apertures, a stack of primary weights being supported on the weight support member by a pin which is specially adapted to carry one or more supplementary weights. A bar assembly for performing diverse barbell exercises is connected by a pair of cables to the weight stacks and includes a pair of spaced apart bar support members which provide limited universal joint action with a lifting bar. Optionally, the cables may have detachable couplings intermediate their lengths in order that the bar assembly may be disconnected from the weight stacks and individual handgrips then connected to the cable segments for performing diverse additional exercises.

2 Claims, 6 Drawing Sheets

85
5
6
45
46
8
7
18
3
54
9
10
50
1
4
12
11
17
42
39
34
13
38
30
14
15
51
16
20
21
22
25
24
23
47
40
2
33
19
32
31
35
28
29

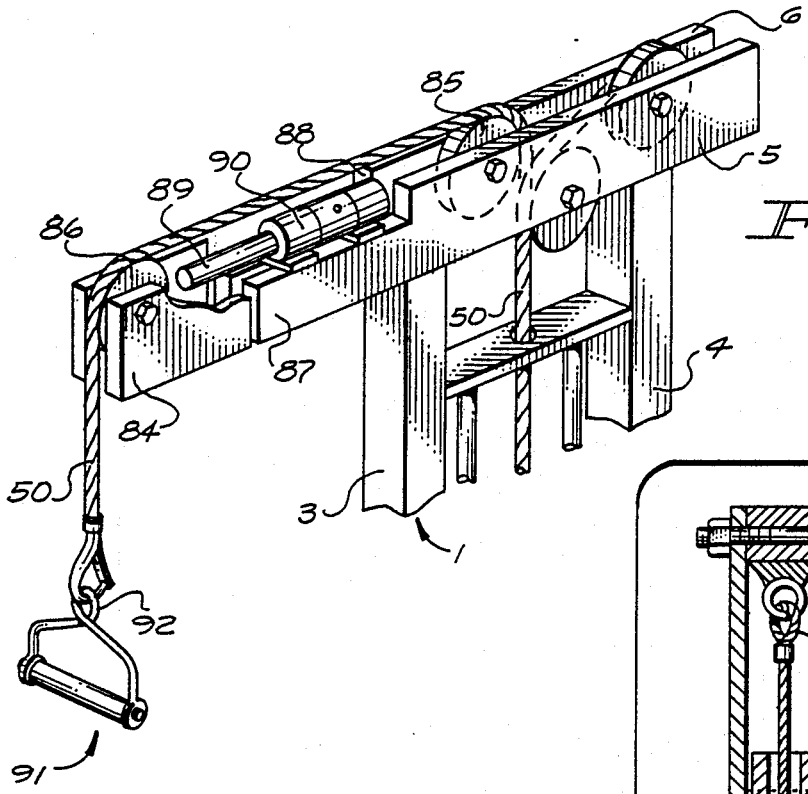
FIG. 2
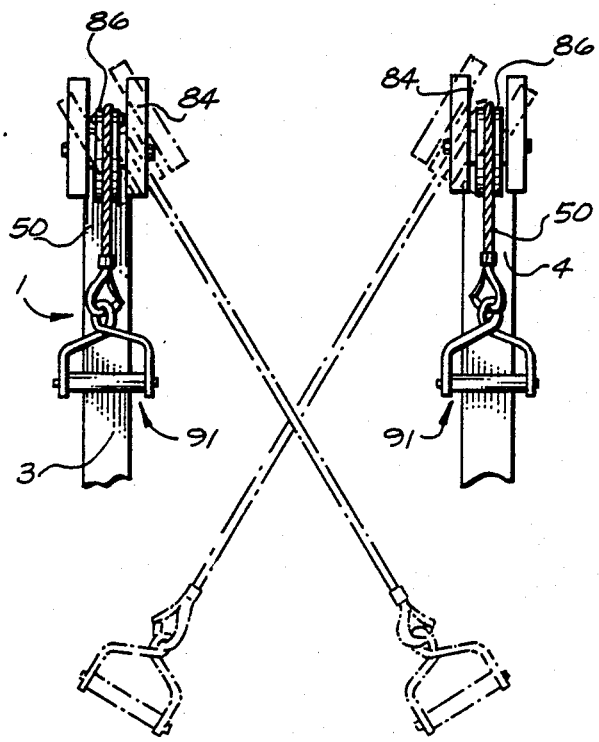
FIG. 4
FIG. 3
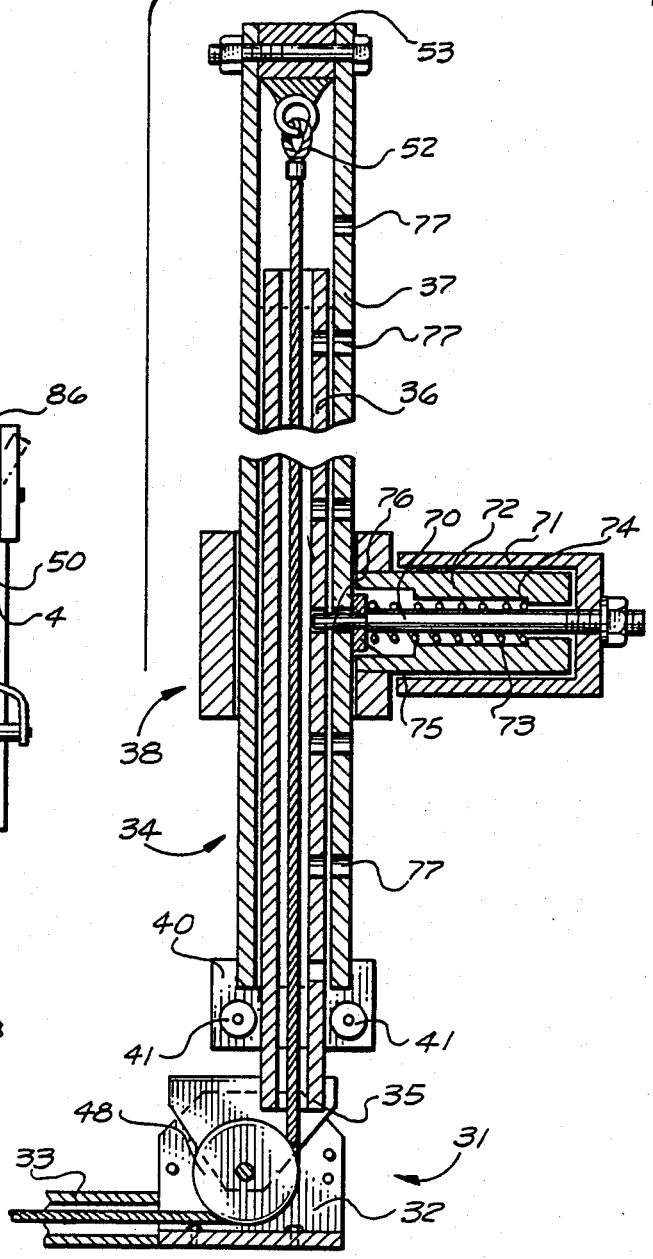

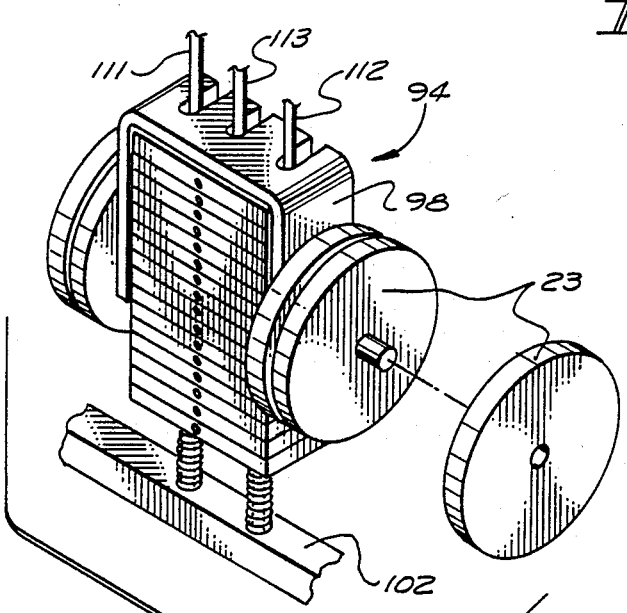
FIG. 13
FIG. 9
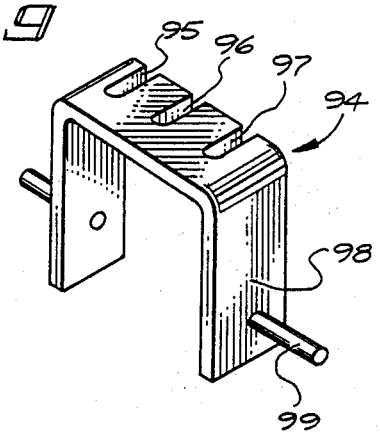
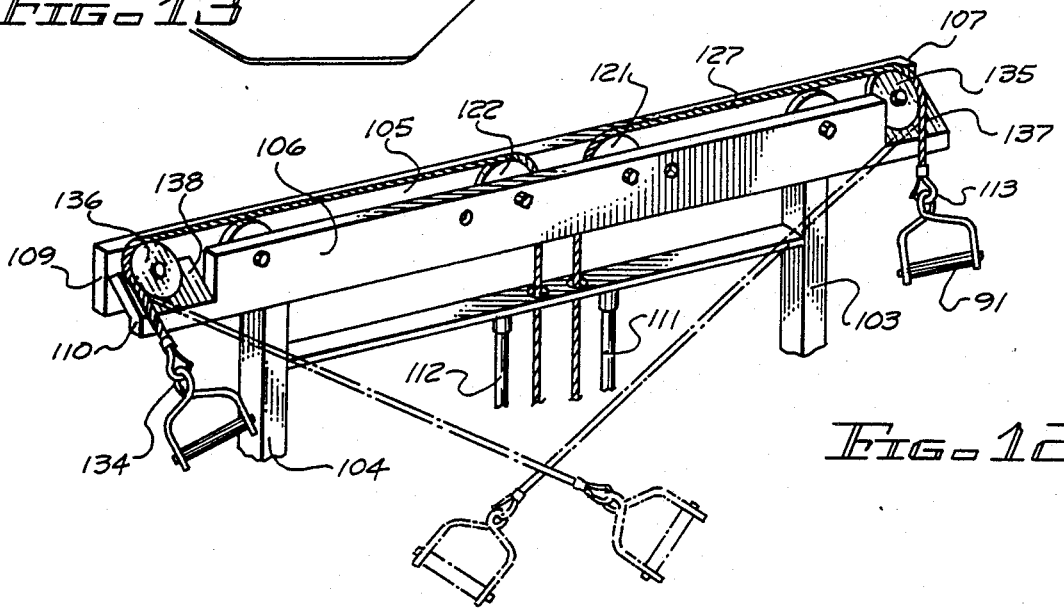
FIG. 12
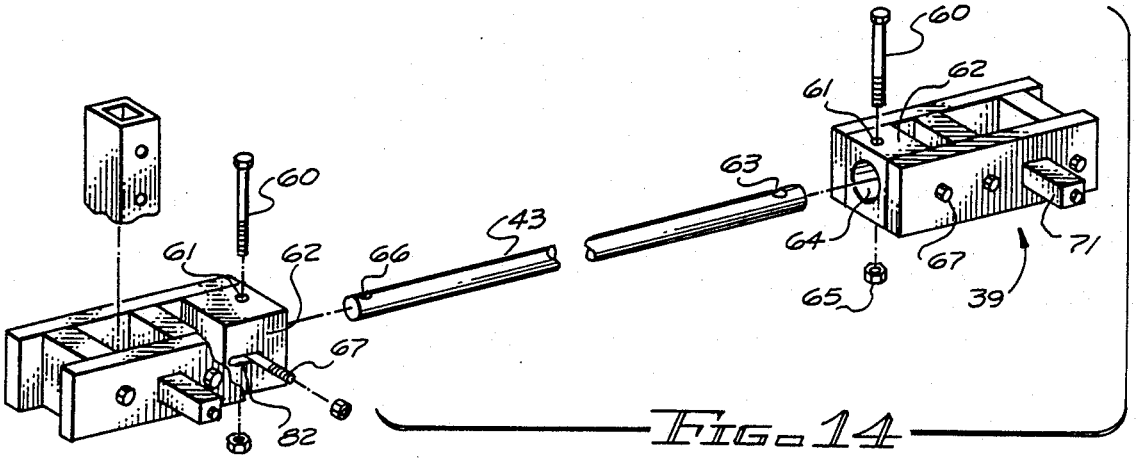
FIG. 14

EXERCISE APPARATUS FOR PERFORMING FREE WEIGHT BARBELL EXERCISES

FIELD OF THE INVENTION

This invention relates to the athletic apparatus arts and, more particularly, to an exercise machine of the class utilizing the technique of raising free weights to obtain the resistive force.

BACKGROUND OF THE INVENTION

Athletic training, particularly strength training, has traditionally incorporated the direct use of free weights and also the use of training machines. Those skilled in the art recognize that there are notable advantages and disadvantages to the use of both free weights and training machines.

With respect to free weights, their use, typically in conjunction with a bar, is the foundation of many training programs, and they have been found to be generally the most efficient way to produce strength and muscle mass. A subtle advantage of the use of free weights is that, since the barbell must be balanced throughout a given lift, rotational and mid-course corrective muscles are developed. However, free weights are not as safe to train with as is a weight machine; weights may fall off the bar, and there is a notoriously well known risk of being pinned by the bar. During the course of a lift, the lifter may strain himself and not be able to control the balance of the barbell. With respect to convenience, it takes more time to perform a given work-out because the weight plates must be continually changed, and the bar has to be placed on and removed from the weight holding stands. Often, the weights are scattered and hard to find. In addition, the floor is inevitably damaged by dropped weights.

With respect to weight/exercise machines, there are numerous advantages to their use which accounts for their widespread popularity. Such machines are safer than free weights in that there is no risk of plates slipping off the bars and no risk of being pinned by the weight. A multi-station universal type weight machine has diverse stations for exercising all the muscle groups of the body, and, for the number of functions provided, such a universal type machine is relatively economical although not inexpensive. Exercise machines are easy to use such that, once a user becomes familiar with them, little or no supervision is required. One can move quickly from one exercise station to another, thus making the machines ideal for aerobic, cardiovascular circuit training in which effort must be sustained. The amount of weight supplying the resistive force can be altered rapidly by simply changing the pin placement, and once in place, the weights cannot be removed without significant effort in disassembling the machine, so they will not become scattered or lost.

However, there are also decided drawbacks to weight/exercise machines. Most exercise machines are fixed in one plane of activity which limits their use to a narrow range of individual movement such that there is no rotational training or training of mid-course corrective muscles. Only two or three exercises can be done for each anatomical part on a standard universal type machine without the use of additional benches, accessory handles, etc. or without moving to another station. Some machines use cams (rather than levers), and these machines still suffer from the fact that they only train the muscles in one plane. On most cam type machines, only one or two exercises can be performed without changing machines. Some machines work muscles in isolation and do not teach coordination. The mechanisms of cam type machines provide inherent bilateral balance and thus don't develop the same tendon or ligament strength in joints. The cam type machines are expensive and take up a lot of space. Isokinetic and hydraulic machines use accommodating resistance such that one can only exercise concentrically, and there is no eccentric load in the return movements.

My invention is directed to eliminating most of the disadvantages of exercising with free weights and machines.

OBJECTS OF THE INVENTION

It is therefore a broad object of my invention to provide exercising apparatus for simulating various free weight barbell type exercises.

In various other aspects, it is among the additional objects of the invention:

- to provide a structured device which is readily adaptable for use in various standing, squatting, overhead, inclined and laying down exercises;
- to provide such exercising apparatus with a self-locking bar assembly for achieving quick adjustment to the desired lifting position;
- to provide a machine type apparatus that trains mid-course corrective muscles by working the user's body from numerous angles;
- to provide apparatus having free weight capabilities coupled with the safety features of universal type machines;
- to provide apparatus with free weight capabilities without the limitation of having the resistance restricted to one plane of activity;
- to provide apparatus having variable cams to produce a variable resistance force;
- to provide exercise apparatus having the capability for the user to move quickly from one exercise position to another, thus making the apparatus ideal for aerobic circuit cardiovascular training;
- to provide such apparatus having provision for rapid and simple weight selection;
- to provide such apparatus having pulleys and handles mounted rearwardly on top of weight stacks to achieve the capability for performing pull down, cross over exercises, the like of which are found only on individual, single purpose prior art exercise machines;
- to provide, in such apparatus, the facility to incrementally add supplementary weight to the weight stacks without increasing the height of the weight stacks; and
- to provide for increasing the poundage on a weight stack in increments less than the weight of a single weight in the stack.

SUMMARY OF THE INVENTION

Briefly, these and other objects of the invention are achieved by a multipurpose exercise apparatus for performing free weight bar bell exercises. The machine includes a pair of spaced apart, upstanding weight frames, each of which includes a frame base; first and second spaced apart columns extending vertically upwardly from the frame base; a pair of spaced apart horizontal top beams fixed to and supported by the columns proximate the upper ends thereof, the top beams each including a first extension portion cantilevered outwardly beyond the second column and a second extension portion cantilevered outwardly beyond the first column; first and second spaced apart weight guides disposed between the first and second columns and extending vertically upwardly from the frame base; an elongated weight support member disposed vertically between the weight guides and including a vertically distributed plurality of mutually parallel horizontal apertures extending therethrough; and a stack of primary weights supported on the weight support member to provide a downward gravitational force thereon. Each of the primary weights have first, second and third vertically directed apertures therethrough for respectively receiving with clearance the first weight guide, the weight support member and the second weight guide; and a horizontally directed aperture intercepting the second vertically directed aperture and alignable with the horizontal apertures in the weight support member. A securement pin is emplaced through the horizontally directed aperture in one of the primary weights and one of said horizontal apertures in the weight support member to affix the selected primary weight and all those above it in the stack to the weight support member.

A first pulley is rotationally supported between the pair of top beams and is positioned such that a tangent thereof is substantially aligned with the weight support member while a second pulley, rotationally supported between said the pair of top beams in the first extension portion, has a tangent common with a tangent of the first pulley. A third pulley is rotationally supported on the frame base and has a tangent common with a tangent of the second pulley.

A bar assembly includes a pair of spaced apart pivot sub-assemblies, each pivot sub-assembly including a base member rigidly connected to one of the frame bases by a hollow beam; a fourth pulley rotationally supported on the base member and having a tangent common with a tangent of the third pulley; a telescoping arm member pivotally fixed proximate one end thereof to the base member and including inner and outer sections each having a plurality of bar positioning apertures distributed along their lengths; and a bar support member.

Each bar support member is adapted to receive and support one end of a lift bar for limited universal joint movement therewith and includes a spring loaded pin selectively engageable with the bar positioning apertures to selectively fix the position of bar support member along the length of outer section of said telescoping arm member and also the telescoping relationship of the inner and outer sections.

Each of a pair of cables is fixed at a first end to the weight support member of one of said weight frames and, in a first configuration of the exercise apparatus, is fixed at a second end to the telescoping arm member. Intermediate its length, the cable passing across the first, second, third and fourth pulleys and passes through the hollow beam.

Optionally, the exercise apparatus further includes a fifth pulley rotationally supported between the pair of top beams and positioned such that a tangent thereof is substantially aligned with the weight support member and a sixth pulley rotationally and pivotally supported on the second extension portions of the top beams. In this configuration, the cable further includes a detachable coupling situated intermediate the second and third pulleys (when the apparatus is in its first configuration) to divide the cable into first and second segments A pair of handgrips, each including a connection region, are provided in order that each of the detachable couplings may be decoupled to separate the cables into first and second segments, each first cable segment may be guided over its respective fifth and sixth pulleys and each handgrip may be attached to the first cable segment to reconfigure the exercise apparatus into a second configuration.

In a refinement of the weight structure, a first section of the pin is dimensioned to be closely received into the horizontally directed apertures in the primary weights, and a second section of the pin is dimensioned to be too large to be received into the horizontally directed apertures. One or more secondary weights are each provided with an aperture therethrough dimensioned to closely receive the second section of the pin in order that the secondary weight(s) may be introduced over the pin second section to provide an incremental increase to the overall downward force applied to the weight support member which is less than the increase resulting from effectively adding another primary weight to increase the overall downward force. In a further refinement, the pin may be provided with a reduced diameter portion which serves to retain the supplementary weight(s) on the pin.

In accordance with a more specific embodiment, a single weight stack provides a resistive force to an adjustable weight bar through use of cables and pulleys. Variable cams are used as some of the pulleys to produce a progressive resistant force on the lift bar. As in the previous embodiment supplementary weights can be added and the lift bar has slight motions which simulate the motions in free weights to exercise rotational and mid-course corrective muscles.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 2 is a partial view of an upper region of the apparatus of FIG. 1 illustrating the manner in which it can be quickly reconfigured from one fundamental configuration to another configuration;

FIG. 3 is a partial cross sectional view illustrating certain of the interior structure of a bar assembly incorporated into the subject machine;

FIG. 4 illustrates certain features associated with using the subject apparatus in an alternative manner provided as shown in FIG. 2;

FIG. 9 is a view of an alternative embodiment for adding supplemental weights;

FIG. 12 is a view of an upper region of the apparatus of FIG. 10 illustrating the manner in which it can be quickly reconfigured from one fundamental configuration to another configuration;

FIG. 13 is a partial view of an alternative embodiment of the subject apparatus illustrating a variant means for adding supplementary weights as shown in FIG. 12;

FIG. 14 is an exploded view of an alternative bar component and its supporting structure;

DETAILED DESCRIPTION OF THE INVENTION

Figure 1:
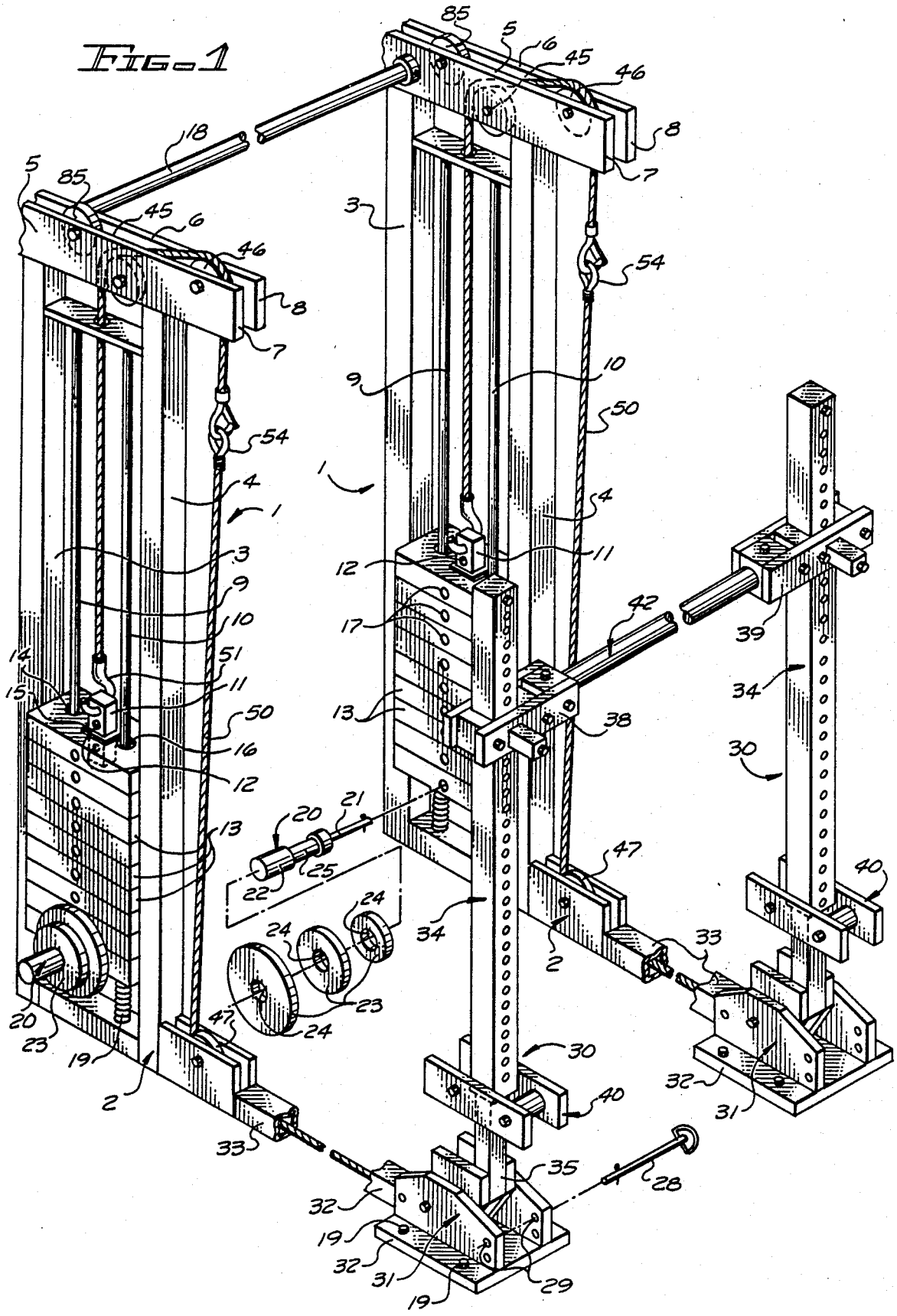
FIG. 1 is a partially broken away pictorial view of the subject exercising machine in a first embodiment.

Referring now to FIG. 1, a presently preferred embodiment of the subject exercise machine is shown in a partially broken away perspective view. From a study of FIG. 1, it will be appreciated that (except for certain details which will be discussed below) the apparatus constitutes substantially mirror image left and right assemblies. Therefore, except for those instances in which left and right components differ, the same reference characters will be used to identify left and right constituents.

Thus, each of a pair of spaced apart, upstanding weight frames 1 includes a frame base 2 and first and second spaced apart columns, 3, 4 extending vertically upwardly from the frame base 2. At the top of each weight frame 1, a pair of spaced apart horizontal top beams 5, 6 are fixed to and supporting by the columns 3, 4 proximate their upper ends. Each top beam 5, 6 includes a firs extension portion 7, 8, respectively, cantilevered outwardly beyond the second column 4 as shown in FIG. 1.

First and second spaced apart weight guides 9, 10 also extend vertically upwardly from the frame base 2 in the region between the first and second columns 3, 4. An elongated weight support member 11 is disposed vertically between the weight guides 9, 10 and includes a vertically distributed plurality of mutually parallel horizontal apertures 12 extending therethrough. At least one primary weight 13 (and typically a stack of primary weights as shown) is supported on the weight support member 11 to provide a downward gravitational force thereon. Each primary weight 13 has first, second and third vertically directed apertures 14, 15, 16 for respectively receiving with clearance the first weight guide 9, the support member 11 and the second weight guide 10. In addition, each primary weight 13 includes a horizontal aperture 17 which intercepts the second vertically directed aperture 15 and is alignable with one of the horizontal apertures 12 in the weight support member 11. As those skilled in the art will appreciate, this more or less conventional arrangement permits a securement expedient, such as a pin 20, to be inserted into a selected one of the horizontal apertures 17 and through the aligned one of the apertures 12 in the support member 11 to affix that particular weight 13 to the weight support member. Thus, any lift occurring at the top of the weight support member 11 must overcome gravitational force exerted by the selected weight 13 and all the weights above it. As will become more evident below, this feature permits changing the resistive force of the apparatus without the necessity to load or unload weights in the weight stack.

Preferably, the pin 20 has a first section 21 dimensioned to be closely received into the horizontally directed apertures 17 of the weights 13 and a second section 22 dimensioned to be too large to be received into the horizontal apertures in the primary weights. As a result, the second section 22 extends outboard (or inboard, since the pin can be inserted from either direction) the stack of weights 13, thereby permitting introduction of one or more supplementary weights 23 over the second section 22 of the pin 20. Supplementary weights 23, which may be graduated, are provided with an aperture 24 to be closely received over the second section 22 of the pin 20, and, typically, an entire set of supplementary weights will be no heavier than a single one of the permanently fixed primary weights 14. As those skilled in the art :;ill appreciate, this feature permits an incremental increase in the downward force supplied by the weight stack in an amount less than that obtained from effectively adding another primary weight to the stack by lowering the pin 20. As a further feature, the second section 22 of the pin 20 may be provided with a reduced diameter portion 25 intermediate along its length in order that the supplementary weights 2 will drop into the reduced diameter portion for more secure retention on the pin. A supplementary weight 23 may subsequently easily be removed by slightly lifting it in order to realign the aperture 24 with the large diameter portion of the second section 2 of the pin 20.

Offset from the weight frames, a bar assembly 30 includes pivot subassembly 31 having a base member 32 rigidly connected to the frame base 2 as by a hollow beam 33. A telescoping arm member 34 included in the pivot subassembly is pivotally fixed proximate its lower end 35 to the base member 32 and, as better shown in FIG. 3, includes an inner section 36 and an outer section 37 disposed in telescoping relationship. Also included in the pivot subassembly 31 movable bar support members 38. The slightly different structure of the bar support members 38, 39 will be discussed below.

Still referring to FIG. 3 as well as FIG. 1, a guide member 40, which may be welded or otherwise affixed to the lower end of the outer section 37 of the telescoping arm member 34, carries a pair of guides 41 which serve to centrally locate the inner section 36 within the outer section 37 of the telescoping arm member 34.

Referring again particularly to FIG. 1, a first pulley 45 is rotationally supported between the pair of top beams 5, 6 such that a tangent of the first pulley is substantially aligned with the weight support member 11. A second pulley 46 is rotationally supported between the cantilevered extensions 7, 8 of the pair of top beams 5, 6 such that the second pulley has a tangent common with a tangent of the first pulley 45. A third pulley 47 is rotationally supported on the frame base 2 and has a tangent common with a tangent of the second pulley 46. Referring to FIG. 3, a fourth pulley 48 is rotationally supported on the base member 32 of the pivot subassembly 31 and has a tangent common with the tangent of the third pulley 47. Referring to both FIGS. 1 and 3, a cable 50 is fixed at one end 51 to the top of the weight support member 11 and, normally, at its other end 52 to fixture 53 disposed at the top of the outer section 37 of the telescoping arm member 34 as best shown in FIG. 3. Between its first end 51 and its second end 52, the cable passes across the first pulley 45, across the second pulley 46, across the third pulley 47, through the hollow beam 33, across the fourth pulley 48 and upwardly through the inner section 36 of the telescoping arm member 34 to the fixture 53. For reasons which will become more apparent below, a detachable coupling 54 is situated intermediate the second and third pulleys 46, 47 such that, when the detachable coupling is separated, the cable 50 may be divided into first and second segments.

Referring again solely to FIG. 1, a brace member 18 may be provided to add structural rigidity to the apparatus. Additionally, the base member 32 may be secured to the floor by bolts 19, and if further rigidity is provided, additional securement to the floor and crossbracing between the weight frames 1 may be provided as may be appropriate.

Extending between bar support members 38, 39 is a bar 42 which has important structural features which may best be understood by reference to FIGS. 3, 5, 6, 7 and 8.

Figure 5:
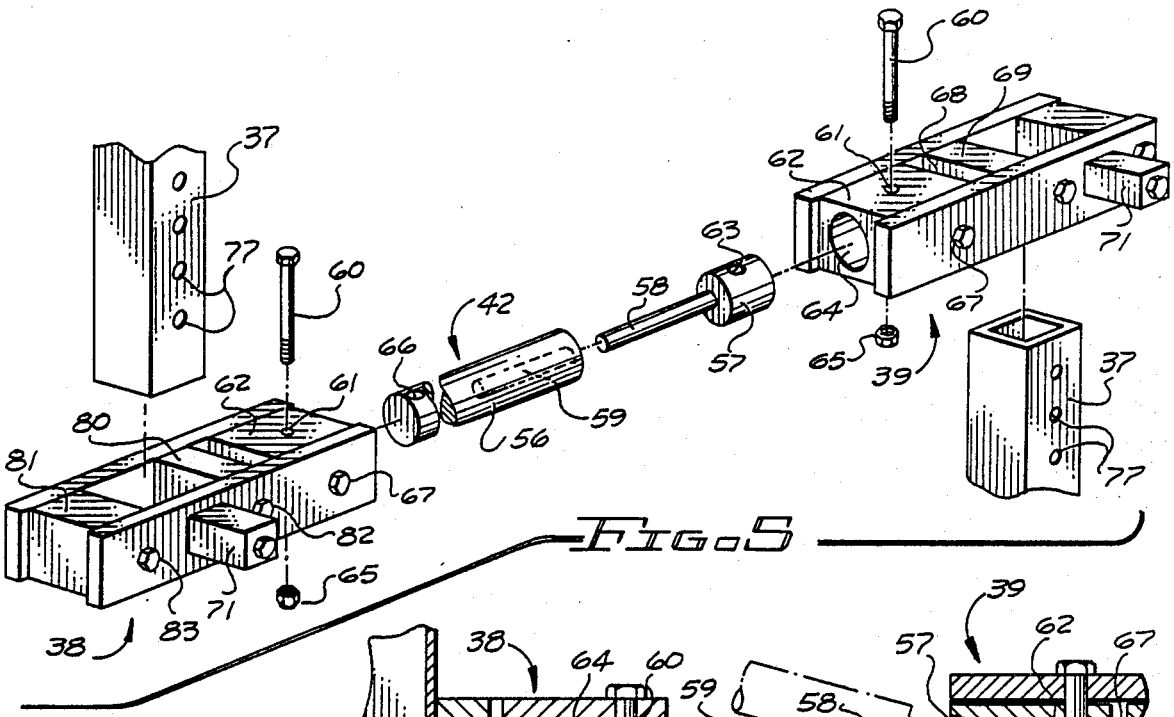
FIG. 5 is an exploded view of a bar component and its supporting structure.

Referring particularly to FIG. 5, it can be seen that the bar 42 includes a main section 56 which spans almost the whole distance between the bar support members 38, 39 and also a secondary section 57 which telescopes into the main section 56. This telescoping action is achieved by providing a reduced diameter portion 58 of the secondary section 57 and a corresponding axial blind hole 59 in the end of the main section 56 facing the secondary section 57. Thus, it will be appreciated that a certain amount of longitudinal sliding movement may be obtained between the two bar sections during use for reasons which will become more apparent below.

Figure 6:
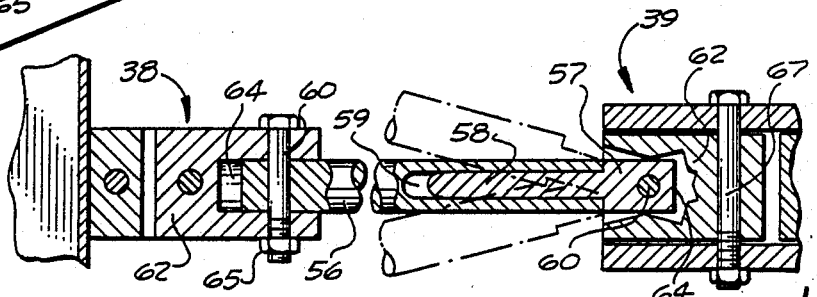
FIG. 6 is a partial cross sectional view illustrating the manner in which universal joint action is obtained in one plane (laterally) and also illustrating the manner in which the length of the bar component may be made slightly variable in order to accommodate various bar positions.

In FIG. 6, it should be noted that the left side of the figure is a side cross sectional view of a portion of the bar support member 38 whereas the right side of the figure is a top cross sectional view of the bar support member 39. Referring first to the structure in the region of the bar support member 39, bolt 60 passes with rotational clearance through an aperture 61 which extends completely through bar receptacle block 62. An aperture 63 is provided in the secondary section 57 of the bar 42 and is dimensioned to be received into the large, horizontally disposed blind hole 64 in the bar receptacle block 62. Thus, the bolt 60, which may be fixed in place by a nut 65, serves to pin the secondary section 57 into the bar receptacle block 62. Attention is particularly directed to the configuration of the blind hole 64 with respect to the pivotal axis provided by the bolt 60. As previously noted, adequate clearance is provided for the bolt 60 passing through the aperture 6 in order that the bar secondary section 57 may enjoy a limited amount of pivotal movement as indicated by the dashed lines in FIG. 6. It will be noted that this movement is substantially restricted to one (lateral) plane. In the region of the bar support member 38, the bolt 60 passes through aperture 61 in bar receptacle block 62 and through aperture 66 proximate the outboard end of the main section 56 of the bar 42. Thus, it will be understood that this end of the bar also enjoys the limited pivoting motion corresponding to that shown in the right portion of FIG. 6 which, it is again noted, is rotated 90 degrees from the left portion.

Figure 8:
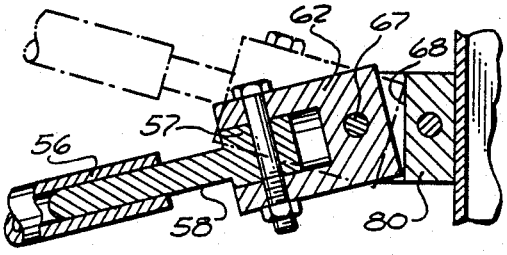
FIG. 8 is a partial cross sectional view, partially broken away, illustrating the manner in which the universal joint action is obtained in another plane (up and down) of the bar component.

Referring also to FIG. 8, it will be seen that the bar receptacle block 62 also enjoys a limited amount of up and down pivoting freedom around the bolt 67 (sufficient clearance being provided in the apertures through which the bolt 67 extends), the up and down movement being limited by the manner in which the rear face of the bar receptacle block 62 engages the inside face 68 of an inner fulcrum bar 80. Those skilled in the art will appreciate that the combination of providing limited back and forth and limited up and down movement for each end of the bar 42 affords a degree of universal joint movement which is an important feature of the subject exercise apparatus.

Attention is additionally again directed to FIG. 3 for a further description of components of the bar support members 38, 39. As will become more apparent during a description of exemplary uses of the subject apparatus, it is desirable to adjust the bar 42 to different positions along the telescoping arm members 34 and also to adjust the effective lengths of the telescoping arm members. Referring particularly to FIG. 3, a detent pin 70 is fixed at one end to the outboard end of a length of square tubing 71. The square tubing 71 fits over a square inner block 72 which contains a compression spring 73 extending from an inside shoulder 74 to a shoulder 75 fixed to the detent pin 70. Since the inner block 72 is fixed to the remaining body of the bar support member 38, pulling outwardly on the square tubing section 71 will release the end 76 of detent pin 70 from any of the apertures 77 which are distributed along the length of the outer section 37 of the telescoping arm member 34 and the corresponding apertures 78 of the inner section 36. Consequently, the bar support members 38, 39 may be placed at any desired position along the length of the telescoping arm member 34 to gain or lose leverage by the user by grasping and pulling outwardly on the square tubing sections 71 to temporarily disengage the bar support members for movement to another position. If it is desired to change the telescoping relationship between the inner sections 36 and outer sections 37 of the arm members 34, this may be done while the detent pin is pulled out of engagement, re-engagement being obtained by releasing the square tubing section 71 once the apertures 77, 78 have been realigned as desired.

Figure 7:
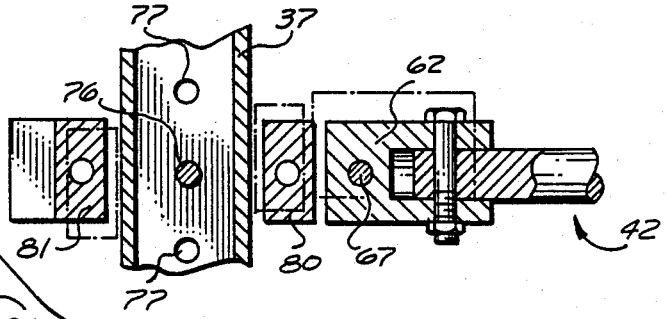
FIG. 7 is a partial cross sectional view illustrating a self locking feature of the bar assembly.

It may at first appear that, in use of the apparatus, a great deal of stress is placed on the end 76 of the detent pin 70. However, great care has been taken to insure that such is not the case. Referring to FIG. 7, when the bar structure is unstressed, it is only necessary that the weight of the bar assembly be borne by the pin ends 76. However, when a lift is undertaken, a component of the force applied by the lifter to the bar 42 lies along the length of the outer section 37 of the telescoping arm member 34. This causes the inner fulcrum bar 80 to move upward and toward the outer section 37 and the outer fulcrum bar 81 to move downwardly toward the outer section; i.e., this portion of the bar support members 38, 39 is pivoting around the end 76 of the detent pin 72, and the sidewalls of the bar support members are acting as lever arms. It will be seen that, since the fulcrum bars are themselves pivotally supported by bolts 82, 83, a condition is promptly achieved in which the component of the lifting force extending along the outer section 37 is taken not by the pin end 76, but rather by the square engagement of the fulcrum bars 80, 81 with the exterior surface of the outer section. The space between the inner fulcrum bar 81 and the back of the bar receptacle block 62 allows the bar 42 to tilt if the weights are not balanced in the weight stack (or if some other system imbalance causing a like effect exists), but only to a degree of inclination at which the bar receptacle block is stopped by contact with the inner fulcrum bar 80 as shown in FIG. 8. When the bar tilts or twists, the bar must lengthen because the telescoping arm members 34 always remain the same distance apart or parallel. FIG. 8 illustrates an extreme position in which the main section 56 of the bar 42 and the reduced diameter portion 58 of the secondary section 57 have undergone axial movement. It will be appreciated that this action occurs in only a small region adjacent the bar support member 39 such that the user of the apparatus has virtually a full span of grip on the outer surface of the main section 56 even in an extreme allowed tilt or skew. It may be noted that the self-locking action described operates upon the same principal whether the force is upward or downward.

Attention is now redirected to FIGS. 1 and 2 in which it will be seen that each weight frame 1 may include a fifth pulley 85 rotationally supported between the top beams 5, 6 such that a tangent of the fifth pulley is substantially aligned with the weight support member 11. In the exemplary embodiment, this is at a higher position than the first pulley 45 so that the common tangential alignment with the weight support member can be achieved. As best shown in FIG. 2, a sixth pulley 86 is rotationally carried by a pivotal member 84 from which an integral shaft 89 extends into a journal member 90 which is supported between cantilevered extensions 87, 88 of the top beams 5, 6.

As particularly well shown in FIGS. 2 and 4, the cable 50 may be divided into its first and second segments by decoupling the detachable coupling 54, rerouting the first segment of the cable 50 over the fifth and sixth pulleys 85, 86 and attaching a handgrip 91 to the cable 50 using a handgrip connection region 92. Those skilled in the art will immediately understand that this exchange, which can be carried out very quickly, reconfigures the exercise apparatus from its first configuration as a bar lift machine to a second configuration in which the handgrips may be used (together or independently) from the other end of the apparatus. As shown in phantom in FIG. 4, it is important that each pivot member 84 have a substantial range of pivoting freedom to allow corresponding freedom to the directions in which the handgrips are pulled to lift the weights (which, it will be recalled, also may be quickly adjusted during the reconfiguration process) to obtain the resistive force. Preferably, the shaft 89 and journal 90 should be positioned close to the cable 86 in order that the pivot point for the pivot member 84 will be close to a tangent of the sixth pulley 86 in order to limit any force tending to pull the cable 50 laterally out of the pulley 86 when the pivot members 84 are being used at a substantial angle from the vertical.

Figure 10:
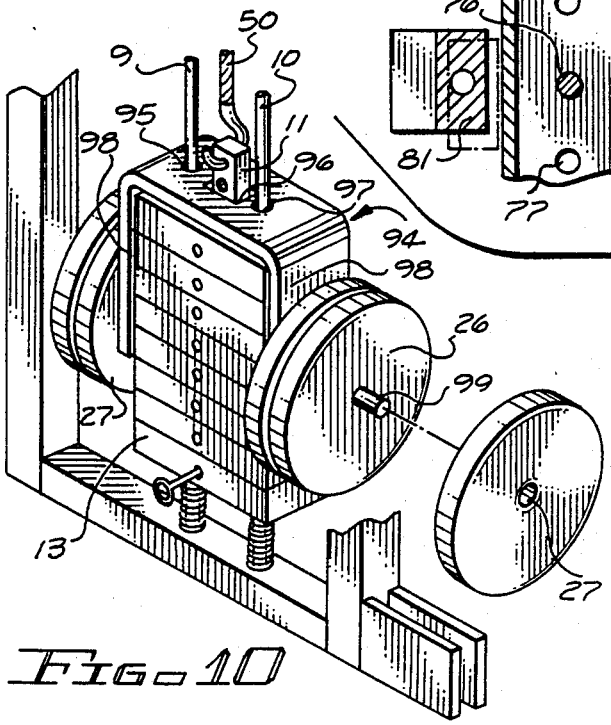
FIG. 10 is a partial view of an alternative embodiment of the subject apparatus illustrating a variant means for adding supplementary weights as shown in FIG. 9, to the permanently emplaced weights in order to achieve a total weight intermediate that which can be obtained by selecting adjacent weights in the weight stack.

Reference may now be taken to FIGS. 9 and 10 which illustrate a variant configuration for adding supplementary weights to incrementally alter the resistive force afforded by the machine. An inverted U-shaped saddle member 94 is provided with first, second and third apertures 95, 96, 97 for respectively receiving with clearance the first weight guide 9, the weight support member 11 and the second weight guide 10. Weight support pins 99 extend horizontally outwardly from the vertical leg sides 98 of the saddle member such that one or more supplementary weights 26 may be fitted to either or both weight support pins by aligning the apertures 27 with the pins and slipping the supplementary weights onto them. The supplementary weights 26 may be selected to have a weight which is less than, equal to, or greater than the primary weights 13, and they may be used alone or in conjunction with the supplementary weight system illustrated in FIG. 1 for the smaller supplementary weights 23. The weight support pins 99 may optionally be provided with reduced diameter portions similar to those of the pins 20 to serve the same office.

Figure 11:
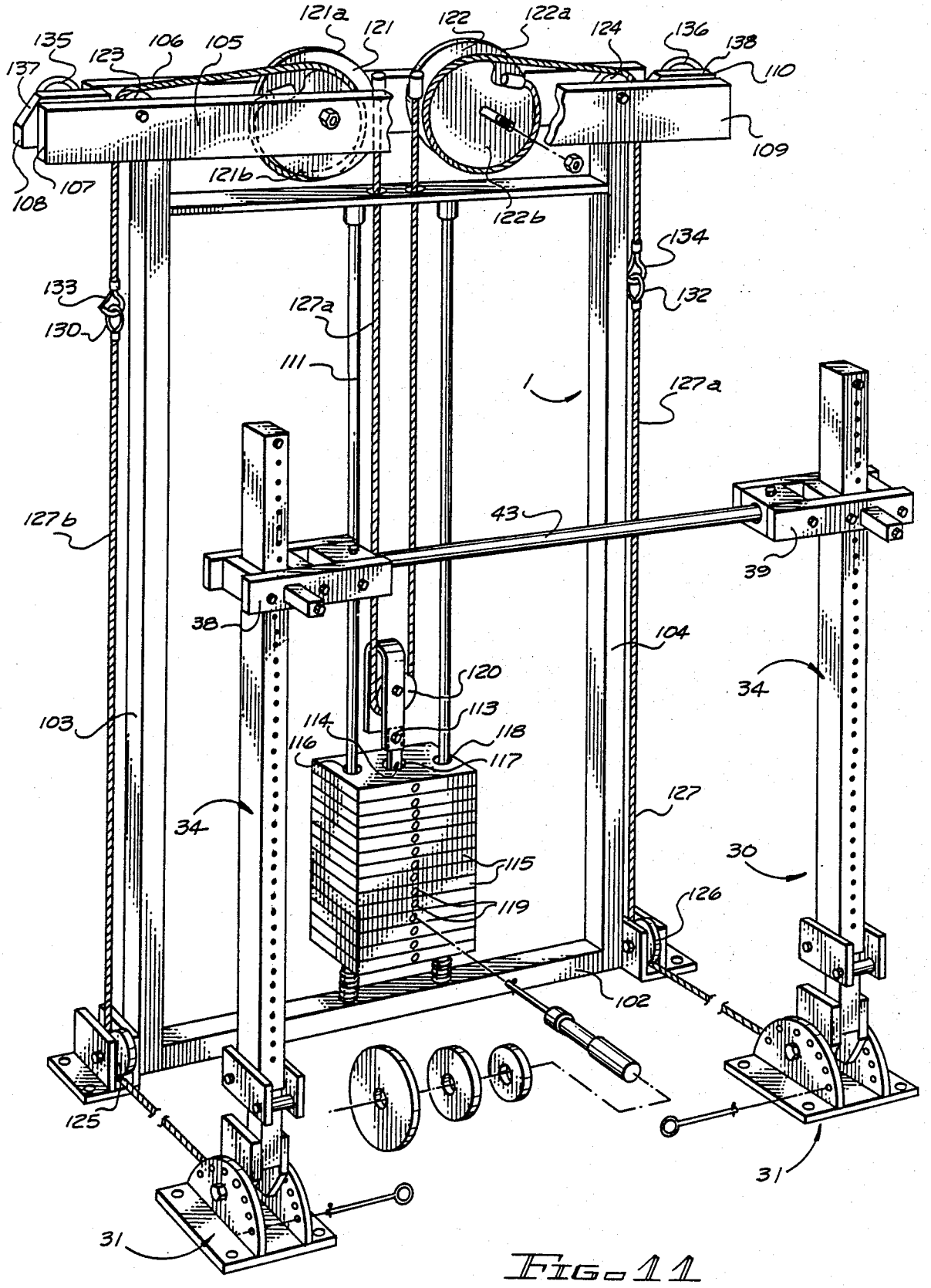
FIG. 11 is a partially broken away pictorial view of the subject exercise machine in a second embodiment.

A second embodiment of the present invention utilizes a single weight stack as illustrated in FIG. 11. An upstanding weight frame 100 includes a frame base 102 and first and second spaced apart columns 103, 104 extending vertically upwardly from frame base 102. At the top of weight frame 100, a pair of spaced apart horizontal top beams 105, 106 are fixed to and supported by columns 103, 104 proximate their upper ends. Each of top beams 105, 106 includes a first extension portion 107, 108 respectively, cantilevered outwardly beyond first column 103 and a second extension portion 109, 110 respectively, cantilevered outwardly beyond second column 104 as shown in FIG. 11.

Spaced apart weight guides 111 and 112 also extend vertically upwardly from frame base 102 in the region between first and second columns 103, 104. An elongated weight support member 113 is disposed vertically between weight guides 111, 112 and includes a vertically distributed plurality of mutually parallel horizontal apertures 114 extending therethrough. At least one primary weight 115 (and typically a stack of primary weights as shown) is supported on weight support member 113 to provide a downward gravitational force thereon. Each primary weight 115 has first, second and third vertically directed apertures 116, 117, 118 for respectively receiving, with clearance, the first weight guide 111, support member 113 and second weight guide 112. In addition, each primary weight 115 includes a horizontal aperture 119 which intercepts second vertically directed aperture 117 and is alignable with one of the horizontal 114 in the weight support member 113. As one skilled in the art will understand, this arrangement is substantially the same as each weight frame of the embodiment illustrated in FIG. 1 and utilizes the sam securement expedient, pin 20. Pin 20 is inserted into a selected one of horizontal apertures 119 and through the alignment one of the apertures 114 in support member 113, to affix that particular primary weight 115 to weight support member 113. Pin 20 is identical to that illustrated in FIG. 1 having the same characteristics and able to receive the same supplementary weights 23.

Still referring to FIG. 11, a first pulley 120 is rotatably coupled to the upper end of weight support member 113. A second and third pulleys 121, 122 respectively are rotatably supported between top beams 105, 106 centrally such that each has a tangent substantially aligned with a tangent of first pulley 120. Fourth and fifth pulleys 123, 124 are rotationally supported between first cantilevered extension 107, 108 and second cantilevered extensions 109, 110 respectively such that fourth pulley 123 has a tangent common with a tangent of second pulley 121 and fifth pulley 124 has a tangent common with a tangent of third pulley 122. A sixth pulley 125 is rotationally supported on frame base 102 outside of first column 103 and has a tangent common with a tangent of fourth pulley 121. The axis of rotation of sixth pulley 125 is turned 90 with respect to fourth pulley 123. Seventh pulley 126 is rotationally supported on frame base 102 outside of second column 104 and has a tangent common with a tangent of fifth pulley 124. The axis of rotation of seventh pulley 126 is also turned 90 with respect to fifth pulley 124.

In this second embodiment, bar assembly 30 is substantially identical to that shown in FIG. 1. Alternate details in bar assembly 30 will be discussed in detail below. Referring to FIG. 11, a cable 127 is fixed at one end 128 to fixture 53 of one telescoping arm member 34, and a second end 129 of cable 127 is fixed to fixture 53 of the opposite telescoping arm member 34. Between first end 128 and second end 129 cable 127 passe down through inner section 36 of telescoping arm member 34, across the lower portion of pulley 45, through hollow beam 33, across the lower portion of sixth pulley 125, across the upper portion of fourth pulley 123, across the upper portion of second pulley 121, down around first pulley 120, up across the upper portion of third pulley 122, across the upper portion of fifth pulley 124, down across the lower portion of seventh pulley 126, through the other hollow beam 33, across the lower portion of the other pulley 48 and upwardly through inner section 36 of the other telescoping arm member 34 to fixture 53. For reasons similar to those discussed for the first embodiment, detachable coupling 130, 132 are situated intermediate the fourth and sixth pulleys 123, 125 and the fifth and seventh pulleys 124, 126 respectively, such that they can be detached to form ends 133, 134.

As illustrated in FIG. 12 an eighth pulley 135 and a ninth pulley 136 are each rotatably coupled to the outside of angled sections 137, 138 proximate each end of second top beam 106 respectively, such that eighth pulley 135 has a tangent common with a tangent of second pulley 121 and ninth pulley 136 has a tangent common with a tangent of third pulley 122. Couplings 130, 132 can be detached and cable ends 133, 134 rerouted over eighth and ninth pulleys 135, 136 respectively. As in FIG. 4 of the first embodiment, hand grips 91 can be attached to cable ends 133, 134. Eighth and ninth pulleys 135, 136 are angled to allow the proper angle of motion for exercises using hand grips.

Second and third pulleys 121, 122 can be in the form of assemblies, each including two pulleys, as shown in FIG. 10. Second pulley 121, as an assembly, includes constant radius pulley 121*a* and variable radius pulley or cam 121*b*. Similarly, third pulley 122 includes pulley 122*a* and cam 122*b*. Cable 127 includes intermediate section 127*a* and first and second terminal sections 127*b* and 127*c*, rexpectively. Respective ends of intermediate section 127*a* are secured to the pulleys 121*a* and 122*a*. In the relaxed state as illustrated, terminal portions of the respective sections 127*b* and 127*c* wrap around and are secured to the cams 121*b* and 122*b*.

The arrangement will produce a progressive resistance movement in a linear stroke. When variable cams are used, the inertia of the weight stack at rest is more easily overcome because the lifting bar for the first half of the exercise stroke travels farther than the weight stack. This gives the lifting bar a mechanical advantage. Conversely in the last half of the exercise stroke, the weight stack travels farther than the lifting bar. Most machines using cams are limited to a single station because the body part being exercised rotates around the axis of the cam. The present invention, however, uses cams as pulleys to produce a progressive resistance in a linear stroke. The linear stroke allows a lift bar to be used separate from the cams. Thus, the lift bar can be repositioned to provide for a wide variety of exercises.

FIG. 13 illustrates a configuration for adding supplementary weights to the machine other than pin 20. This configuration is illustrated in FIGS. 9 and 10 for the first embodiment and can be used in the same manner in the second embodiment.

FIG. 14 illustrates a alternate bar component substantially identical to the bar component illustrated in FIG. 5 with modifications to bar recepticle 62 and telescoping bar 42 replaced with a solid bar 43.

Figure 15:
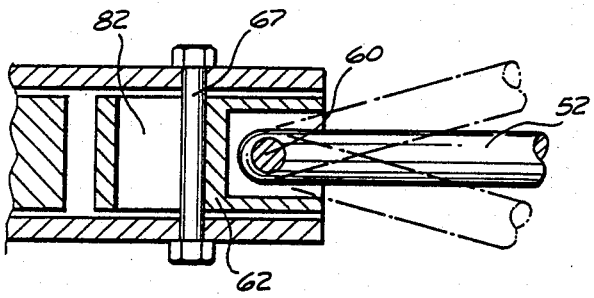
FIG. 15 is a partial cross-sectional top view illustrating an alternative manner in which universal joint action is obtained and also an alternative manner in which the length of the bar component may be slightly variable.
Figure 16:
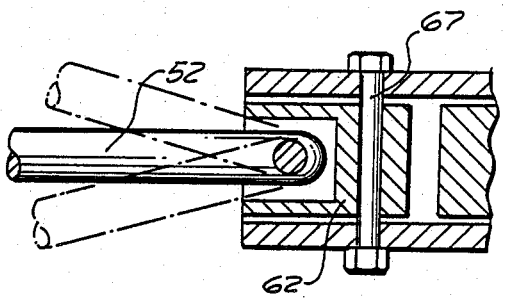
FIG. 16 is a partial cross-sectional top view of the bar component opposite the portion illustrated in FIG. 15.
Figure 18:
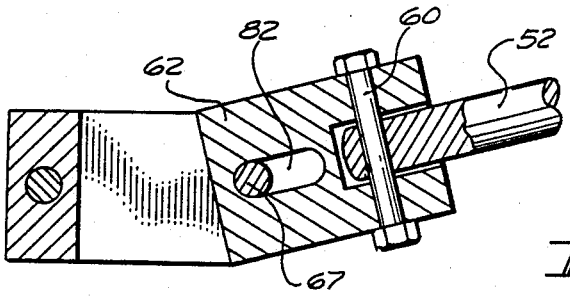
FIG. 18 is a partial cross-sectional view illustrating the manner in which the universal joint action is obtained in another plane of the alternative bar component.

Referring to FIG. 14, it can be seen that bar 43 is a solid length between bar support members 38, 39. Bar 43 fits into blind holes 64 of bar recepticles 62 and is coupled as bar 42 is coupled in FIG. 5. FIGS. 15 and 16 illustrate the pivotal movement of bar 43 around the axis provided by bolt 60. A certain amount of longitudinal sliding movement is also desired, as obtained in the first embodiment by the telescoping action of bar 42. In the alternative embodiment, bar recepticle block 62 in left support member 38 performs a longitudinal sliding motion. Recepticle block 62 still enjoys a limited amount of up and down pivoting freedom around bolt 67 as illustrated in FIG. 18, however, in the alternate embodiment illustrated in FIG. 14 aperture 82, through which bolt 67 passes, is not limited to sufficient clearance for the pivot action, but is enlarged horizontally. Recepticle block 62 will slide in a longitudinal direction which will substantially duplicate the telescoping action of bar 42.

Figure 17:
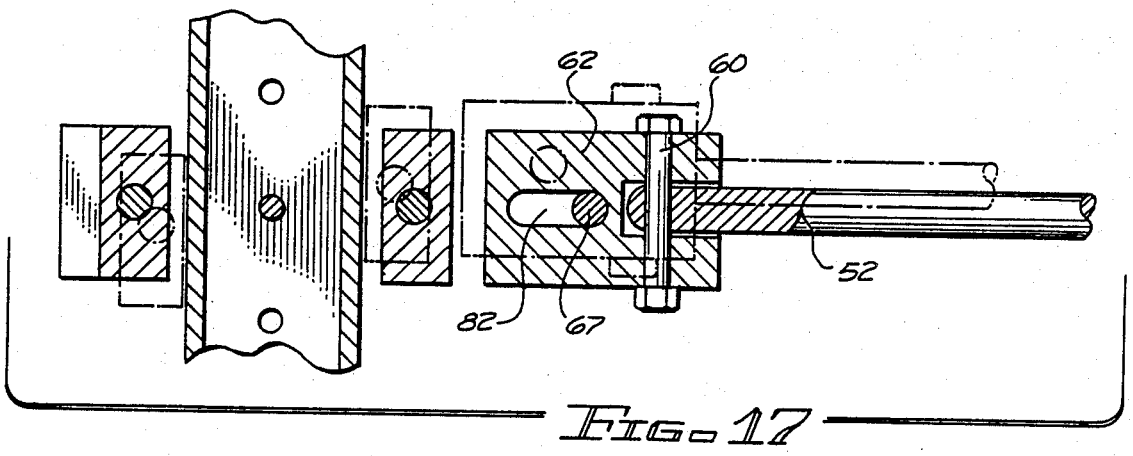
FIG. 17 is a partial cross-sectional view illustrating a self-locking feature of the alternative bar component.

FIG. 17 illustrates the self-locking feature of the bar support member in the alternate embodiment. As can be seen, the alternate embodiment works identically to the preferred embodiment illustrated in FIG. 7.

In operation, the exercise apparatus may be configured as a bar lift device as illustrated in FIG. 1 in which each end of the bar 42 enjoys limited universal joint support in order that different weight loads on the two machine sides can be accommodated and also in order that mid-course corrective muscles and other muscles are appropriately trained. This universal joint action, permitting as it does relative skew between the bar 42 and the telescoping arm members 34, extends the versatility of the apparatus by presenting unbalanced conditions, deliberate or a consequence of imbalance in the development of the anatomy, which, when compensated for, tend to develop the physique of the user in a bilaterally balanced, symmetrical fashion.

During such bar lift operation (which may take various forms of standing, squatting, reclining, overhead, laying down, etc. exercises), it may be desirable to supplement the inherent safety of the apparatus by providing a limit pin 28 which can be passed through apertures 29 in the base member 32 such that the angle toward the horizontal through which the telescoping arm members 34 may rotate is limited. The limit pin 28 may also serve to define a "parked" position of the bar assembly 30. Still further safety is afforded by the provision of compression springs 19 around each of the weight guides 9, 10 in the first embodiment and weight guides 111, 112 in the second embodiment, the compression springs being positioned between the frame base 2 and 102 and the lowermost primary weight 13 and 115. The compression springs 19 thus situated serve to bring the weight stacks to a controlled stop during their descent as when the forces supplied by the weight stacks are no longer resisted.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. In an exercise machine in which resistive force is supplied by the downward gravitational force on a weight support member supplied by a primary weight stack which is lifted during use of the machine and in which the effective number of weights in the stack is selected by inserting a pin into the bottom weight of the selected group to affix the selected bottom weight to the weight support member, the improvement wherein:

(a) said pin includes (i) a first section dimensioned to be closely received into said horizontally directed aperture in said primary weight;

(ii) a second section dimensioned to be too large to be received into said horizontally directed aperture in said parimary weight; and (b) at least one supplementary weight is selectively emplaceable on said pin to increase the downward gravitational force on the weight support member by an amount which is less that the amount which would be obtained by lowering the position of said pin in said stack of weights.

2. The improvement of claim 1 in which said second section is further characterized by a reduced diameter portion positioned intermediate the length of said second such that said supplementary weight is retained on said reduced diameter portion during use of the exercise machine.

* * * * *

UNITED STATES PATENT AND TRADEMARK OFFICE

CERTIFICATE OF CORRECTION

PATENT NO. : 4,974,838

DATED : December 4, 1990

INVENTOR(S) : Carl E. Sollenberger, et al.

It is certified that error appears in the above-identified patent and that said Letters Patent is hereby corrected as shown below:

The title page should be deleted to appear as per attachaed title page.

Signed and Sealed this

Twenty-third Day of June, 1992

*Attest:*

DOUGLAS B. COMER

*Attesting Officer*

*Acting Commissioner of Patents and Trademarks*

United States Patent [19]

Sollenberger

[11] Patent Number: 4,974,838

[45] Date of Patent: Dec. 4, 1990

[54] EXERCISE APPARATUS FOR PERFORMING FREE WEIGHT BARBELL EXERCISES

[76] Inventor: Carl E. Sollenberger, 3914 E. Captain Dreyfus, Phoenix, Ariz. 85032

[21] Appl. No.: 413,393

[22] Filed: Sep. 27, 1989

[51] Int. Cl.[5] ..... A63B 21/062

[52] U.S. Cl. ..... 272/118; 272/123

[58] Field of Search ..... 272/117, 118, 123, 134

[56] References Cited

U.S. PATENT DOCUMENTS

| | | | |
|---|---|---|---|
| 3,612,523 | 10/1971 | Glynn | 272/118 |
| 3,627,315 | 12/1971 | Marcyan | 272/118 |
| 3,858,873 | 1/1975 | Jones . | |
| 3,998,454 | 12/1976 | Jones | 272/117 |
| 4,050,310 | 9/1977 | Keiser . | |
| 4,072,309 | 2/1978 | Wilson . | |
| 4,227,689 | 10/1980 | Keiser . | |
| 4,257,590 | 3/1981 | Sullivan et al. | 272/117 |
| 4,257,593 | 3/1981 | Keiser . | |
| 4,339,125 | 7/1982 | Uyeda et al. | 272/118 |
| 4,387,893 | 6/1983 | Baldwin | 272/118 |
| 4,564,194 | 1/1986 | Dawson | 272/123 |
| 4,598,908 | 7/1986 | Morgan | 272/134 |
| 4,603,855 | 8/1986 | Sebelle | 272/117 |
| 4,711,448 | 12/1987 | Minrow et al. | 272/118 |
| 4,781,374 | 11/1988 | Lederman | 272/134 |
| 4,784,384 | 11/1988 | Deola | 272/118 |
| 4,842,271 | 6/1989 | Vinciguerra | 272/118 |

*Primary Examiner*—Robert Bahr

*Attorney, Agent, or Firm*—Don J. Flickinger; Jordan M. Meschkow

[57] ABSTRACT

A multipurpose exercise apparatus for performing free weight bar bell exercises includes a pair of weight frames, each of which includes spaced apart columns and spaced apart horizontal top beams supported by the columns. A weight support member is disposed vertically between the columns and includes a plurality of apertures, a stack of primary weights being supported on the weight support member by a pin which is specially adapted to carry one or more supplementary weights. A bar assembly for performing diverse barbell exercises is connected by a pair of cables to the weight stacks and includes a pair of spaced apart bar support members which provide limited universal joint action with a lifting bar. Optionally, the cables may have detachable couplings intermediate their lengths in order that the bar assembly may be disconnected from the weight stacks and individual handgrips then connected to the cable segments for performing diverse additional exercises.

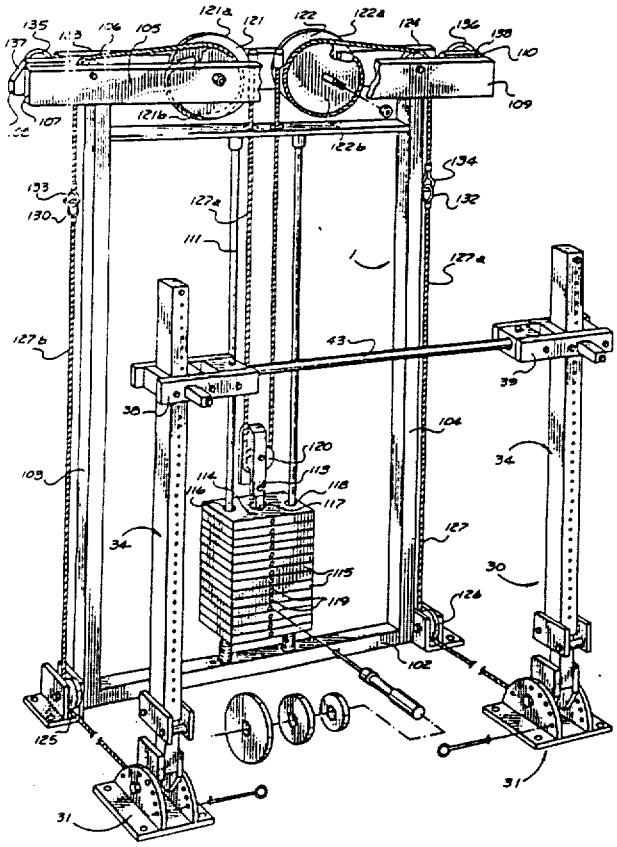

2 Claims, 6 Drawing Sheets